US008413585B2

(12) United States Patent
Heitmann

(10) Patent No.: US 8,413,585 B2
(45) Date of Patent: Apr. 9, 2013

(54) PROJECTILE

(75) Inventor: Thomas Heitmann, Unterlüss (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 249 days.

(21) Appl. No.: 12/785,330

(22) Filed: May 21, 2010

(65) Prior Publication Data

US 2011/0023743 A1 Feb. 3, 2011

Related U.S. Application Data

(63) Continuation-in-part of application No. PCT/EP2008/009238, filed on Nov. 3, 2008.

(30) Foreign Application Priority Data

Nov. 23, 2007 (DE) ..... 10 2007 056 785

(51) Int. Cl.
*F42B 12/16* (2006.01)
*F42B 10/04* (2006.01)
*F42B 12/22* (2006.01)

(52) U.S. Cl. ..... 102/476; 102/491

(58) Field of Classification Search ..... 102/357, 102/389, 394, 475, 476, 478, 481, 489, 491, 102/492, 493
See application file for complete search history.

(56) References Cited

U.S. PATENT DOCUMENTS 1,325,706 A * 12/1919 Todisco ..... 102/495
3,808,972 A 5/1974 Cammack et al.
3,901,158 A 8/1975 Ferb
3,906,860 A 9/1975 Johns
4,284,007 A * 8/1981 Arnell et al. ..... 102/477
4,305,333 A 12/1981 Altenau
4,312,274 A 1/1982 Zernow
4,494,459 A 1/1985 Ziemba
(Continued)

FOREIGN PATENT DOCUMENTS

DE 100 18 285 A1 10/2001
DE 100 25 055 A1 12/2001
DE 102 27 002 A1 1/2004
WO 01/79780 A1 10/2001

OTHER PUBLICATIONS

"kraftschlüssig": Dr.-Ing. Richard Ernst, Wörterbuch Der Industriellen Technik 684 (Udo Amm ed., 6th ed. 2004).
"formschlüssigen": Dr.-Ing. Richard Ernst, Wörterbuch Der Industriellen Technik 441 (Udo Amm ed., 6th ed. 2004).

(Continued)

*Primary Examiner* — Bret Hayes
(74) *Attorney, Agent, or Firm* — Griffin & Szipl, P.C.

(57) ABSTRACT

The invention relates to a projectile (1) having a projectile casing (3) in which an explosive charge (8), surrounded by a fragmentation casing, (9) is disposed, wherein the fragmentation casing (9) is fixed to the projectile casing (3), and the projectile (1) comprises a first ignition unit (11) adjacent to the explosive charge (8) disposed to the rear for igniting the explosive charge (8). The projectile (1) may be selectively used as a fragmentation projectile or as a projectile whose effect is due to pressure waves resulting from explosion of the explosive charge (8) due to an ejection charge (15), and the explosive charge (8) is axially displaceable relative to the fragmentation casing (9), which allows the explosive charge (8) to slide out of the projectile casing (3) at least far enough so that the explosive charge cannot act on the fragmentation casing (9) to fragment it.

10 Claims, 2 Drawing Sheets

U.S. PATENT DOCUMENTS

| | | | | |
|---|---|---|---|---|
| 4,655,139 | A * | 4/1987 | Wilhelm | 102/494 |
| 4,712,482 | A * | 12/1987 | Bock et al. | 102/501 |
| 4,807,533 | A * | 2/1989 | von Entress-Fursteneck | 102/489 |
| 4,949,639 | A * | 8/1990 | Burns | 102/249 |
| 5,210,372 | A * | 5/1993 | Tripptrap et al. | 102/489 |
| 5,235,916 | A | 8/1993 | Winger | |
| 5,251,530 | A | 10/1993 | Kaeser | |
| 5,313,890 | A | 5/1994 | Cuadros | |
| 5,542,354 | A * | 8/1996 | Sigler | 102/478 |
| 6,474,240 | B1 * | 11/2002 | Chemiere et al. | 102/487 |
| 6,666,146 | B2 | 12/2003 | Wardecki et al. | |
| 6,857,372 | B2 | 2/2005 | Renaud-Bezot et al. | |
| 6,966,265 | B2 | 11/2005 | Ronn et al. | |
| 7,168,368 | B1 * | 1/2007 | Warner et al. | 102/489 |
| 7,418,905 | B2 | 9/2008 | Bootes et al. | |
| 8,006,623 | B2 | 8/2011 | Dupont et al. | |
| 2002/0014177 | A1 | 2/2002 | Renaud-Bezot et al. | |
| 2002/0166475 | A1 | 11/2002 | Brooks et al. | |
| 2010/0282115 | A1 * | 11/2010 | Sheridan et al. | 102/491 |

OTHER PUBLICATIONS

Office Action issued in co-pending related U.S. Appl. No. 12/786,124 on Oct. 19, 2011.

International Search Report issued in corresponding PCT/EP2008/009238, mailed Mar. 18, 2009, completed Mar. 25, 2009.

International Search Report issued in co-pending application PCT/EP2008/009239, mailed Mar. 19, 2009, completed Mar. 27, 2009.

* cited by examiner

PROJECTILE

This is a Continuation-in-Part Application in the United States of International Patent Application No. PCT/EP2008/009238 filed Nov. 3, 2008, which claims priority on German Patent Application No. DE 10 2007 056 785.7, filed Nov. 23, 2007. The entire disclosures of the above patent applications are hereby incorporated by reference.

FIELD OF THE INVENTION

The invention relates to a projectile having a projectile casing in which an explosive charge, surrounded by a fragmentation casing, is arranged wherein the fragmentation casing is connected, in particular, securely to the projectile casing, and wherein, for igniting the explosive charge, the projectile includes a (first) ignition device adjacent to the explosive charge at the rear, and the ignition time of this ignition device can preferably be adjusted.

BACKGROUND OF THE INVENTION

Fragmentation projectiles are customarily constructed in such a way that they enable a targeted strong fragmentation effect in enclosed spaces or in open country. It is, therefore, not possible in accordance with known fragmentation projectiles to use them effectively when the respective combat situation requires that no fragments affect the relevant target, but only the pressure waves resulting during the explosion are to be utilized. Such a situation can occur, for example, when a terrorist group is to be combated with a tank projectile embodied as a fragmentation projectile and the tank commander determines immediately before firing the projectile that there is a kindergarten in the vicinity of the terrorist group so that the fragments of the projectile would also endanger a large number of innocent parties.

The object of the present invention is to provide a projectile that can optionally be used as a fragmentation projectile, or as a projectile for which the effect of the pressure waves produced during the explosion of the explosive charge are mainly utilized.

SUMMARY OF THE INVENTION

This object is achieved according to the invention by the features of a first embodiment directed to a projectile having a projectile casing (3) in which an explosive charge (8) is arranged surrounded by a fragmentation casing (9), wherein the projectile (1) includes an ignition device (11) adjacent to the explosive charge (8) at the rear for igniting the explosive charge (8), characterized in that (a) the explosive charge (8) is supported in the projectile casing (3) so that it can be displaced in the axial direction towards the rear (14) of the projectile (1), and (b) in that an ejection charge (15) is situated in the projectile casing (3), which ejection charge is embodied and arranged in the projectile casing (3) in such a way that after ignition of the ejection charge (15), the developing propellant gases effect a pushing of the explosive charge at the rear out of the fragmentation casing (9). Other, particularly advantageous embodiments of the invention are summarized as follows.

In accordance with a second embodiment of the present invention, the first embodiment is modified so that the ignition device (11) can be adapted in such a way that the explosive charge (8) is optionally ignited without prior activation of the ejection charge (15) or only after activation of the ejection charge (15) and the complete pushing-out of the ejection charge (8) from the fragmentation casing (9). In accordance with a third embodiment of the present invention, the first embodiment or the second embodiment is further modified so that the ignition time of the ignition device (11) can be adjusted. In accordance with a fourth embodiment of the present invention, the first embodiment, the second embodiment and the third embodiment are further modified so that the fragmentation casing (9) is securely connected to the projectile casing (3). In accordance with a fifth embodiment of the present invention, the first embodiment, the second embodiment, the third embodiment and the fourth embodiment are further modified so that the projectile casing (3) and the fragmentation casing (9) are connected to one another by means of several steel grooved pins (10) arranged uniformly distributed over the circumference.

In accordance with a sixth embodiment of the present invention, the first embodiment, the second embodiment, the third embodiment, the fourth embodiment and the fifth embodiment are further modified so that the explosive charge (8) and the first ignition device (11) are connected to one another in a non-positive manner and form a unit (13). In accordance with a seventh embodiment of the present invention, the sixth embodiment is further modified so that the explosive charge (8) is composed of a metal jacket (7) that is connected to the first ignition device (11) in a non-positive manner. In accordance with an eighth embodiment of the present invention, the sixth embodiment or the seventh embodiment is further modified so that the ejection charge (15) is arranged in an annular cavity (16) that surrounds the outside of the fragmentation casing (9) and that the unit (13) comprising explosive charge (8) and the first ignition device (11) has a radially protruding annular surface (17) on which the developing propellant gases act after ignition of the ejection charge (15). In accordance with an ninth embodiment of the present invention, the eighth embodiment is further modified so that the radially protruding annular surface (17) is the front side of the first ignition device (11) facing the explosive charge (8).

In accordance with a tenth embodiment of the present invention, the first embodiment, the second embodiment, the third embodiment, the fourth embodiment, the fifth embodiment, the sixth embodiment, the seventh embodiment, the eighth embodiment, and the ninth embodiment, are further modified so that the projectile (1) is a fin-stabilized tank projectile having a caliber $\geqq 100$ mm. In accordance with an eleventh embodiment of the present invention, the first embodiment, the second embodiment, the third embodiment, the fourth embodiment, the fifth embodiment, the sixth embodiment, the seventh embodiment, the eighth embodiment, the ninth embodiment, and the tenth embodiment are further modified so that the projectile (1) is a projectile having two warheads (4, 5) arranged axially one behind the other in the projectile casing (3), wherein the first warhead (5) at the rear is embodied as a fragmentation warhead with an explosive charge (8) at the rear that can be displaced. In accordance with a twelfth embodiment of the present invention, the eleventh embodiment is further modified so that the second warhead (4) is a hollow charge warhead.

In sum, the present invention is based essentially on the concept of arranging an ejection charge in the projectile, as well as an explosive charge that can be displaced axially with respect to the fragmentation casing, which makes it possible to push the explosive charge out of the projectile casing at least so far that during explosion it no longer acts on the fragmentation casing securely connected to the projectile casing. Thus, if the ejection charge is not activated in a projectile of this type, then the projectile acts as a "pure" fragmentation projectile because the explosive charge—as with known projectiles—is situated inside the fragmentation casing. If, on the other hand the ejection charge is activated before the ignition of the explosive charge, then the explosive charge is first pushed out at least partially from the projectile casing and, thus, from the fragmentation casing, so the subsequently activated explosive charge does not cause any ripping apart of the fragmentation casing remaining in the residual projectile. In this case, only the pressure waves of the explosive charge take substantial effect in the target zone because the fragmentation casing is not fragmented during the explosion.

In a particularly advantageous embodiment of the present invention, the explosive charge and the first ignition device are connected to one another in a non-positive manner and form a unit. To achieve the required minimum strength when the projectile is fired, the explosive charge is thus surrounded by a carrier jacket (for example, a copper jacket), which is connected to the first ignition device in a non-positive manner.

The ejection charge is preferably arranged in an annular cavity surrounding the fragmentation casing on the outside, and the unit composed of the explosive charge and the first ignition device has a radially protruding annular surface on which, after ignition of the ejection charge, the resulting propellant charge gases act. The radially protruding annular surface of the first ignition device can, thus, be the front side of the housing of the first ignition device, wherein the front side faces the explosive charge.

To attach the fragmentation casing to the projectile casing, it has proven to be expedient to provide several steel grooved pins arranged uniformly distributed over the circumference. In addition, the projectile can, for example, be a fin-stabilized tank projectile having a caliber 100 mm (e.g., having a caliber of 120 mm).

Depending on the use of the projectile, in accordance with the present invention, it can be advantageous if the projectile has two warheads arranged axially one behind the other in the projectile casing. The first warhead arranged at the rear is embodied as a fragmentation warhead with an explosive charge that can be displaced at the rear, and the second warhead, arranged at the front, is embodied as a hollow charge warhead. The second warhead, then, generates, for example, an opening in the wall of a building or armored vehicle by means of the resulting hollow charge blast, and through this opening the first warhead travels into the building and then inside the building and acts either as a fragmentation projectile or, when the explosive charge is pushed out of the fragmentation casing, the first warhead acts through the effect of the pressure waves of its explosive charge.

BRIEF SUMMARY OF THE DRAWINGS

Further details and advantages of the invention are disclosed in the following exemplary embodiments explained on the basis of the figures, which show.

DETAILED DESCRIPTION OF THE INVENTION

Figure 1:
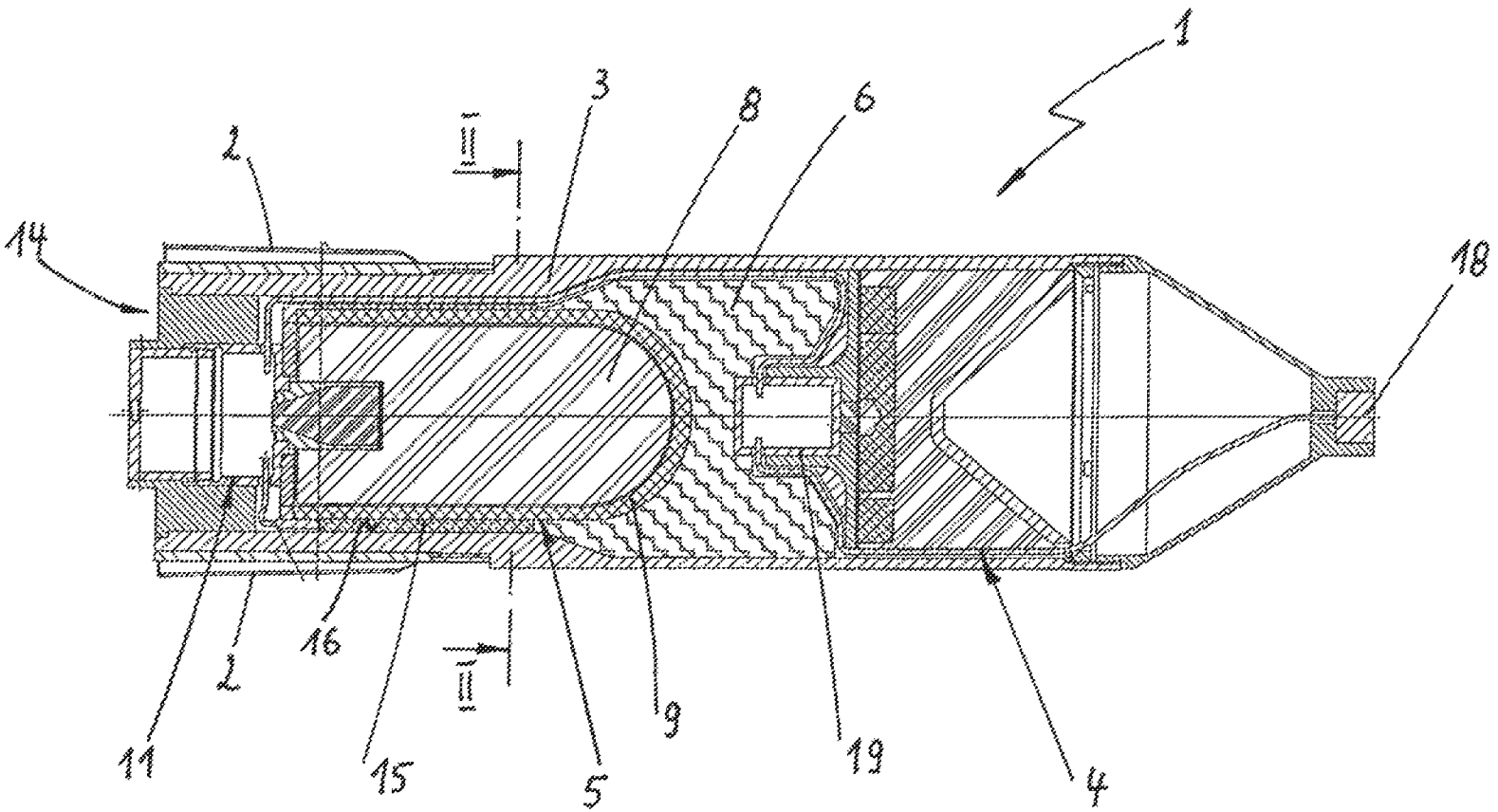
FIG. 1 illustrating a longitudinal section through a projectile according to the present invention and having two warheads, wherein the first warhead located at the rear comprises a unit composed of an explosive charge and a first ignition device.

In FIG. 1, 1 designates a large-caliber fin-stabilized projectile, (having a caliber of, e.g., 120 mm), which can be fired, for example, from a tank cannon. The fins 2 of a wrap-around tail assembly are still in the not yet unfolded state and, at the rear of the projectile, are wrapped around a projectile casing 3. Thus, the fins 2 are movable between the folded state and the unfolded state.

In the exemplary embodiment shown, two warheads 4, 5 are arranged axially behind one another in the projectile casing 3. The first warhead 5, located at the rear of the projectile, is embodied as a fragmentation warhead and the second warhead 4, situated in front of the first warhead, is embodied as a hollow charge warhead. The two warheads 4, 5 are separated from one another by a damper element 6 so that when the hollow charge warhead 4 is activated, the developing pressure waves do not cause any destruction or activation of the first warhead 5.

Figure 2:
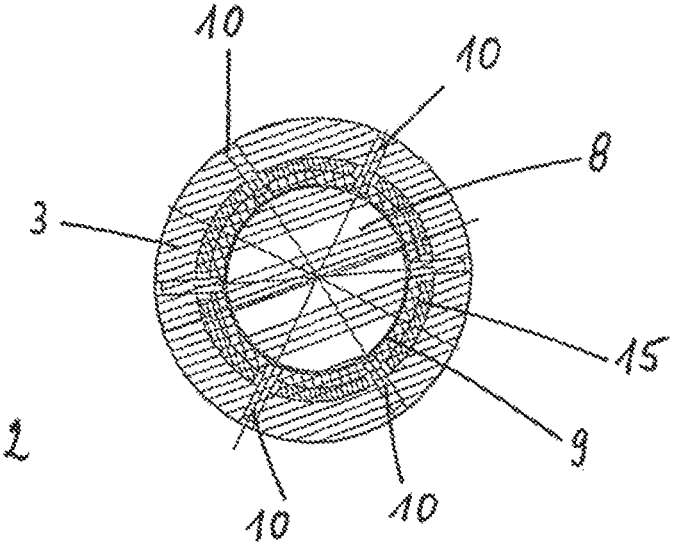
FIG. 2 illustrates a cut through or cross-section of the projectile shown in FIG. 1, wherein the cut through is along the cut line designated in FIG. 1 by II-II.
Figure 3:
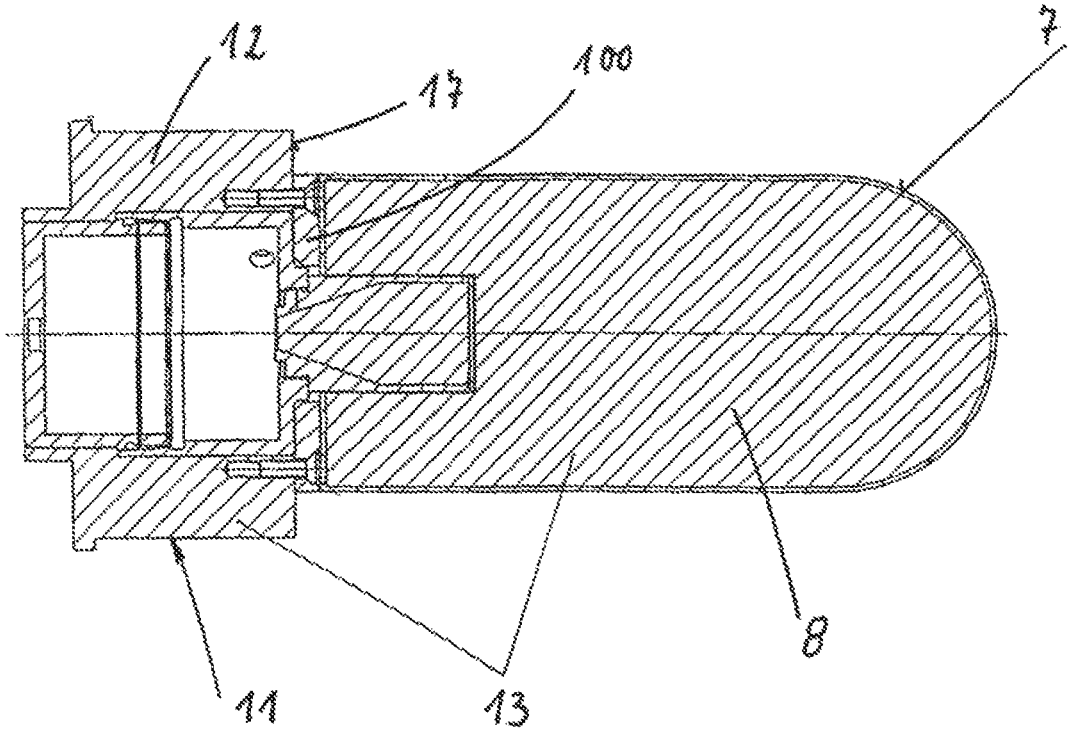
FIG. 3 shows an enlarged longitudinal section of the unit shown in FIG. 1, wherein the unit is composed of an explosive charge and the first ignition device.

In the first warhead 5, as shown in FIGS. 1 and 3, an explosive charge 8 surrounded by a carrier jacket 7 (e.g., a copper jacket) is arranged so that the explosive charge 8 is situated inside a fragmentation casing 9 that is connected to the projectile casing 3. The fragmentation casing 9 is connected securely to the projectile casing 3 via several steel grooved pins 10 arranged uniformly distributed over the circumference of the projectile casing 3 and of the fragmentation casing 9 (See FIG. 2).

Moreover, to ignite the explosive charge 8 in the projectile casing 3, a first ignition device 11, the ignition time of which can be adjusted, is arranged adjacent to, and at the rear of, the explosive charge 8 (for reasons of better visibility, in FIGS. 1 and 3, only the receptacle device for the igniter, otherwise not shown, is reproduced). The explosive charge 8 and the housing 12 of the first ignition device 11 are connected to one another in a non-positive manner via a flange 100, embodied in the form of a plate, so that the explosive charge 8 and the first ignition device 11 form a unit 13. This unit 13 is fixed inside the projectile casing 3 as shown in FIG. 1, and, for example, the first ignition device 11 is adhered or pressed into the projectile casing 3.

According to the present invention, it is now provided that the explosive charge 8 is supported so that it can be displaced in the projectile casing 3 in the axial direction towards the rear 14 of the projectile 1. The pushing is effected by means of an ejection charge 15, which is arranged in an annular cavity 16 surrounding the fragmentation casing 9 on the outside of the fragmentation casing 9. The cavity 16 is limited at the rear by a radially protruding annular surface 17 of the housing 12 of the first ignition device 11 (See FIG. 3). Thus, the annular surface 17 of the housing 12 of the first ignition device 11 provides a limit to the rear of the cavity 16.

Operation of the Projectile of the Invention to Produce a Fragmentation Effect

If, for example, an armored target is presently to be attacked using the projectile 1 of the present invention, wherein fragments of the first warhead 5 are to take full effect in the interior of the target, then the projectile 1 is fired at the target without beforehand transmission of additional information about ignition of the ejection charge 15 to the first ignition device 11. In other words, when firing the projectile 1 at the target without first transmitting additional information regarding ignition of the ejection charge 15, then the ejection charge 15 is not ignited and the explosive charge 8 will explode inside the fragmentation casing 9, thereby ripping the fragmentation casing 9 open and producing high speed fragments.

Therefore, as soon as a sensor 18 arranged at the front of the projectile 1 strikes the target, the hollow charge warhead 4 is ignited by means of a second ignition device 19. The hollow charge blast produced thereby generates an opening in the corresponding wall of the target, then, through this opening, the first warhead 5 reaches the interior of the target. Simultaneously with the activation of the second ignition device 19, the first ignition device 11 is also activated, which then, after entry of the first warhead 5 into the target, activates the explosive charge 8 so that the fragmentation casing 9 rips open and fragments are hurled radially into the interior of the target at high speed. In this case, the first ignition device 11 is operating in a first mode of operation so that the projectile 1 behaves substantially as a fragmentation projectile.

Operation of the Projectile of the Invention to Generate a Pressure Wave Effect

If now the interior space of the target is to be damaged as little as possible by fragments, and only the pressure wave generated by the activation of the explosive charge 8 is to take effect, then an additional piece of information is entered by the tank commander into the first ignition device 11, the ignition time of which can be adjusted, so that the ejection charge 15 is activated shortly before the actual ignition of the explosive charge 8. Thus, when the ejection charge 15 is activated before the explosive charge 8 is activated, the activated charge 15 develops propellant gases, and through the developing propellant gases, the unit 13, which is composed of the first ignition device 11 and the explosive charge 8, is ejected into the interior space of the target against the direction of firing (i.e., the unit 13 is ejected towards the rear of the projectile 1), and the fragmentation casing 9 remains in the residual projectile. Consequently, the explosive charge 8 is then ignited through the first ignition device 11 connected to it, but only after the ejection of the explosive charge 8 rearward from the projectile casing 3 so that the developing pressure waves from the activated explosive charge 8 no longer act on the fragmentation casing 9.

In other words, when the ejection charge 15 is activated before the explosive charge 8 is ignited, propellant gases developed by the activated ejection charge 15 ejects the unit 13 rearward from the projectile 1 so that when the explosive charge 8 ignites, it is not surrounded by the fragmentation casing 9 so the fragmentation casing 9 does not rip open and fragments of the fragmentation casing 9 are not produced. In this case, the first ignition device 11 is operating in a second mode of operation so that the projectile 1 behaves substantially as a projectile utilizing primarily pressure waves to effect a target.

The invention is of course not limited to the exemplary embodiment described above. Thus, it is in particular not required that the projectile be composed of two warheads. Rather, as a rule, no additional hollow charge warhead is provided so that the projectile is composed only of one warhead provided with a fragmentation casing, and an explosive charge that can be displaced with respect to the fragmentation casing.

It is also not imperative that the ejection charge be arranged as an annular charge in the projectile casing, but instead can be arranged, for example, at the front of the projectile, and before the explosive charge, so that the developing propellant gases due to activation of the ejection charge still act on the jacket of the explosive charge.

Furthermore, instead of the fragmentation casing being fixed to the projectile casing by means of grooved pins, these units can also be connected in a different positive and/or non-positive manners. Finally, the projectile casing can also form the fragmentation casing itself so that a separate connection between these units can be omitted completely.

REFERENCE LIST

1 Projectile
2 Fin
3 Projectile casing
4 (Second) warhead, hollow charge warhead
5 (First) warhead, fragmentation warhead
6 Damper element
7 Copper jacket, carrier jacket
8 Explosive charge
9 Fragmentation casing
10 Steel grooved pin
11 First ignition device
12 Housing
13 Unit (i.e., comprising the explosive charge 8 and the first ignition device 11)
14 Rear of the projectile
15 Ejection charge
16 Cavity
17 Annular surface of the housing
18 Sensor
19 Second ignition device
100 Flange

The invention claimed is:

1. A projectile comprising:

(a) a projectile casing in which an explosive charge is arranged;

(b) a fragmentation casing, wherein the explosive charge is surrounded by a fragmentation casing, and wherein the projectile casing and the fragmentation casing are connected to one another by several steel grooved pins arranged so as to be uniformly distributed over a circumference of the projectile casing and of the fragmentation casing;

(c) a unit comprising (i) the explosive charge, wherein the explosive charge is supported in the projectile casing so that the explosive charge is displaceable in an axial direction towards the rear of the projectile, and wherein the explosive charge is surrounded by a metal jacket;

(ii) a first ignition device disposed adjacent to the explosive charge and at a rear of the projectile, wherein the metal jacket of the explosive charge and the first ignition device are connected to one another, wherein the first ignition device is operably connected to ignite the explosive charge, and wherein the first ignition device includes a housing; and (iii) a radially protruding annular surface, wherein the radially protruding annular surface is a surface of the housing of the first ignition device; and (d) an ejection charge, wherein the ejection charge is situated in the projectile casing, wherein the ejection charge is configured and arranged in the projectile casing, in an annular cavity that surrounds an outside of the fragmentation casing, so that after ignition of the ejection charge, propellant gases developing due to ignition of the ejection charge act on the radially protruding annular surface of the first ignition device housing, and thereby effect a pushing of the explosive charge toward the rear of the projectile and out of the fragmentation casing so that ignition of the explosive charge does not rip the fragmentation casing apart and hurl high speed fragments.

2. A projectile according to claim 1, wherein the first ignition device operates in a first mode and in a second mode, wherein in the first mode the first ignition device operates to ignite the explosive charge without prior activation of the ejection charge, and in the second mode the first ignition devices operates to ignite the explosive charge only after activation of the ejection charge and a complete pushing-out of the explosive charge from the fragmentation casing that occurs due to propellant gases developed due to activation of the ejection charge.

3. A projectile according to claim 2, wherein an ignition time of the ignition device is adjustable.

4. A projectile according to claim 1, wherein an ignition time of the first ignition device is adjustable.

5. A projectile according to claim 1, wherein the radially protruding annular surface is on a front side of the first ignition device facing the explosive charge.

6. A projectile according to claim 1, wherein the projectile is a fin-stabilized tank projectile having a caliber ≧100 mm.

7. A projectile according to claim 1, wherein the projectile has two warheads arranged axially one behind the other in the projectile casing, wherein a first warhead is located at the rear of the projectile and is a fragmentation warhead provided with the explosive charge.

8. A projectile according to claim 7, wherein the second warhead is a hollow charge warhead.

9. A projectile according to claim 7, wherein the second warhead is located in front of the first warhead, and the second warhead is a hollow charge warhead, and the projectile further comprises a second ignition device operably connected to ignite the second warhead.

10. A projectile according to claim 1, wherein the metal jacket is copper.

* * * * *